US011892211B2

(12) United States Patent
Witt et al.

(10) Patent No.: US 11,892,211 B2
(45) Date of Patent: Feb. 6, 2024

(54) COMPRESSOR FLOW RESTRICTOR

(71) Applicant: Copeland LP, Sidney, OH (US)

(72) Inventors: Brandon Jerome Witt, Sidney, OH (US); Philip L. Landfair, Sidney, OH (US); Vishal Kumar Vaghela, Pune (IN); Satyam Anandrao Shinde, Pune (IN)

(73) Assignee: Copeland LP, Sidney, OH (US)

( * ) Notice: Subject to any disclaimer, the term of this patent is extended or adjusted under 35 U.S.C. 154(b) by 0 days.

(21) Appl. No.: 17/749,997

(22) Filed: May 20, 2022

(65) Prior Publication Data

US 2022/0373240 A1 Nov. 24, 2022

(30) Foreign Application Priority Data

May 23, 2021 (IN) ..... 202121022956

(51) Int. Cl.
*F25B 41/48* (2021.01)
*F25B 31/00* (2006.01)

(52) U.S. Cl.
CPC ..... *F25B 41/48* (2021.01); *F25B 31/002* (2013.01); *F25B 2400/061* (2013.01)

(58) Field of Classification Search
CPC ..... F25B 41/48; F25B 31/002; F25B 31/004; F25B 2309/061; F25B 2400/061; F25B 2400/0751; F25B 2400/13; F25B 2600/0253; F25B 2600/026; F25B 31/026; F25B 9/008; F25B 2400/06; F25B 2400/075
See application file for complete search history.

(56) References Cited

U.S. PATENT DOCUMENTS 3,542,338 A 11/1970 Domer
3,763,659 A 10/1973 Hover
3,777,509 A 12/1973 Muench
(Continued)

FOREIGN PATENT DOCUMENTS

CN 109114237 A * 1/2019 ..... F16K 1/42
CN 110749133 A 2/2020
JP 5064561 B2 10/2012

OTHER PUBLICATIONS

Pdf is translation of foreign reference CN-109114237-A (Year: 2019).*

(Continued)

*Primary Examiner* — Len Tran
*Assistant Examiner* — Kamran Tavakoldavani
(74) *Attorney, Agent, or Firm* — Harness, Dickey & Pierce, P.L.C.

(57) ABSTRACT

A climate-control system may include a first compressor, a second compressor, a suction manifold, and a flow restrictor. The first and second compressors each include a shell and a compression mechanism. The shells define suction chambers from which the compression mechanisms draw working fluid. The shells include suction inlet fittings through which working fluid is drawn into the suction chambers. The suction inlet fittings are fluidly connected to the suction manifold. The suction manifold provides suction-pressure working fluid to the suction inlet fittings of the first and second compressors. The flow restrictor may be at least partially disposed within the suction manifold.

21 Claims, 3 Drawing Sheets

(56) References Cited

U.S. PATENT DOCUMENTS

| | | | | |
|---|---|---|---|---|
| 4,383,802 | A | 5/1983 | Gianni et al. | |
| 4,750,337 | A | 6/1988 | Glamm | |
| 5,996,364 | A | 12/1999 | Lifson et al. | |
| 8,398,387 | B2 | 3/2013 | Shiotani et al. | |
| 9,470,230 | B2 | 10/2016 | Koyama et al. | |
| 10,081,226 | B2 | 9/2018 | Connell et al. | |
| 2007/0033965 | A1 | 2/2007 | Lifson et al. | |
| 2010/0202909 | A1 | 8/2010 | Shiotani et al. | |
| 2013/0330210 | A1* | 12/2013 | Bonnefoi | F04B 39/0207 417/62 |
| 2019/0323497 | A1 | 10/2019 | Raskar et al. | |
| 2020/0072521 | A1* | 3/2020 | Goel | F25B 31/00 |

OTHER PUBLICATIONS

Indian Office Action regarding Application No. 202121022956, dated Dec. 30, 2022.
International Search Report regarding Application No. PCT/US2022/030513 dated Sep. 15, 2022.
Written Opinion of the ISA regarding Application No. PCT/US2022/030513 dated Sep. 15, 2022.

* cited by examiner

COMPRESSOR FLOW RESTRICTOR

CROSS-REFERENCE TO RELATED APPLICATIONS

This application claims the benefit and priority of Indian Patent Application No. 202121022956, filed May 23, 2021. The entire disclosure of the above application is incorporated herein by reference.

FIELD

The present disclosure relates to a climate-control system, such as a multiple-compressor system with a flow restrictor.

BACKGROUND

This section provides background information related to the present disclosure and is not necessarily prior art.

A climate-control system such as, for example, a heat-pump system, a refrigeration system, or an air conditioning system, may include a fluid circuit having an outdoor heat exchanger, an indoor heat exchanger, an expansion device disposed between the indoor and outdoor heat exchangers, and one or more compressors circulating a working fluid (e.g., refrigerant) between the indoor and outdoor heat exchangers. During operation of a multiple-compressor system, an oil level in one or more of the compressors may decrease while an oil level in another one or more of the compressors may increase. The present disclosure provides means for equalizing the oil levels between the multiple compressors and/or reducing an oil deficit in one of more of the compressors. Maintaining adequate oil levels in the compressor will improve efficiency and reliability of the compressors and will enable the climate-control system to effectively and efficiently provide a cooling and/or heating effect on demand.

SUMMARY

This section provides a general summary of the disclosure and is not a comprehensive disclosure of its full scope or all of its features.

The present disclosure provides a climate-control system that may include a first compressor, a second compressor, a suction manifold, and a flow restrictor. The first compressor may include a first shell and a first compression mechanism. The first shell may define a first suction chamber from which the first compression mechanism draws working fluid. The first shell may include a first suction inlet fitting through which working fluid is drawn into the first suction chamber. The second compressor may include a second shell and a second compression mechanism. The second shell may define a second suction chamber from which the second compression mechanism draws working fluid. The second shell may include a second suction inlet fitting through which working fluid is drawn into the second suction chamber. The suction manifold may be fluidly connected to the first and second suction inlet fittings. The flow restrictor may be disposed at least partially within the suction manifold. The flow restrictor may include a body, a flange, and an aperture extending through the body and the flange. The flange may extend radially outward from the body.

In some configurations of the climate-control system of the above paragraph, the flow restrictor is brazed to the suction manifold.

In some configurations of the climate-control system of either of the above paragraphs, the outer diameter of the flange is larger than an inner diameter of the suction manifold.

In some configurations of the climate-control system of any one or more of the above paragraphs, a braze material fixedly attaches the flow restrictor to the suction manifold.

In some configurations of the climate-control system of any one or more of the above paragraphs, the braze material contacts the flange and an axial end surface of the suction manifold.

In some configurations of the climate-control system of any one or more of the above paragraphs, the braze material contacts a chamfered surface of the flange.

In some configurations of the climate-control system of any one or more of the above paragraphs, the flow restrictor is partially received in an end of the suction manifold and engages the first suction inlet fitting of the first compressor.

In some configurations of the climate-control system of any one or more of the above paragraphs, the flow restrictor extends out of the end of the suction manifold and is concentric with the end of the suction manifold and the first suction inlet fitting.

In some configurations of the climate-control system of any one or more of the above paragraphs, the first shell defines a first lubricant sump disposed within the first suction chamber, and the second shell defines a second lubricant sump disposed within the second suction chamber. The climate-control system may include a lubricant equalization conduit engaging the first and second shells and fluidly connecting the first lubricant sump with the second lubricant sump.

In some configurations of the climate-control system of any one or more of the above paragraphs, the flow restrictor is partially received in a first end of the suction manifold and engages the first suction inlet fitting of the first compressor. A second end of the suction manifold engages the second suction inlet fitting. In some configurations, the second end of the suction manifold does not include a flow restrictor.

In some configurations of the climate-control system of any one or more of the above paragraphs, at least one of the flow restrictor and the suction manifold includes markings indicating a size of an inner diameter of the flow restrictor.

The present disclosure also provides a climate-control system including a first compressor, a second compressor, a suction manifold, and a flow restrictor. The first compressor may include a first shell and a first compression mechanism. The first shell may include a first suction inlet fitting through which working fluid is drawn into the first compressor for compression in the first compression mechanism. The second compressor may include a second shell and a second compression mechanism. The second shell may include a second suction inlet fitting through which working fluid is drawn into the second compressor for compression in the second compression mechanism. The suction manifold fluidly may be connected to the first and second suction inlet fittings. The flow restrictor may be disposed at least partially within the suction manifold. The flow restrictor may include a body, a flange, and an aperture extending through the body and the flange. The flange may extend radially outward from the body.

In some configurations of the climate-control system of the above paragraph, the flow restrictor is brazed to the suction manifold.

In some configurations of the climate-control system of either of the above paragraphs, the outer diameter of the flange is larger than an inner diameter of the suction manifold.

In some configurations of the climate-control system of any one or more of the above paragraphs, a braze material fixedly attaches the flow restrictor to the suction manifold.

In some configurations of the climate-control system of any one or more of the above paragraphs, the braze material contacts the flange and an axial end surface of the suction manifold.

In some configurations of the climate-control system of any one or more of the above paragraphs, the braze material contacts a chamfered surface of the flange.

In some configurations of the climate-control system of any one or more of the above paragraphs, the flow restrictor is partially received in an end of the suction manifold and engages the first suction inlet fitting of the first compressor.

In some configurations of the climate-control system of any one or more of the above paragraphs, the flow restrictor extends out of the end of the suction manifold and is concentric with the end of the suction manifold and the first suction inlet fitting.

In some configurations of the climate-control system of any one or more of the above paragraphs, the first shell defines a first suction chamber and a first lubricant sump disposed within the first suction chamber, and the second shell defines a second suction chamber and a second lubricant sump disposed within the second suction chamber. The climate-control system may include a lubricant equalization conduit engaging the first and second shells and fluidly connecting the first lubricant sump with the second lubricant sump.

In some configurations of the climate-control system of any one or more of the above paragraphs, the flow restrictor is partially received in a first end of the suction manifold and engages the first suction inlet fitting of the first compressor. A second end of the suction manifold engages the second suction inlet fitting. In some configurations, the second end of the suction manifold does not include a flow restrictor.

In some configurations of the climate-control system of any one or more of the above paragraphs, at least one of the flow restrictor and the suction manifold includes markings indicating a size of an inner diameter of the flow restrictor.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
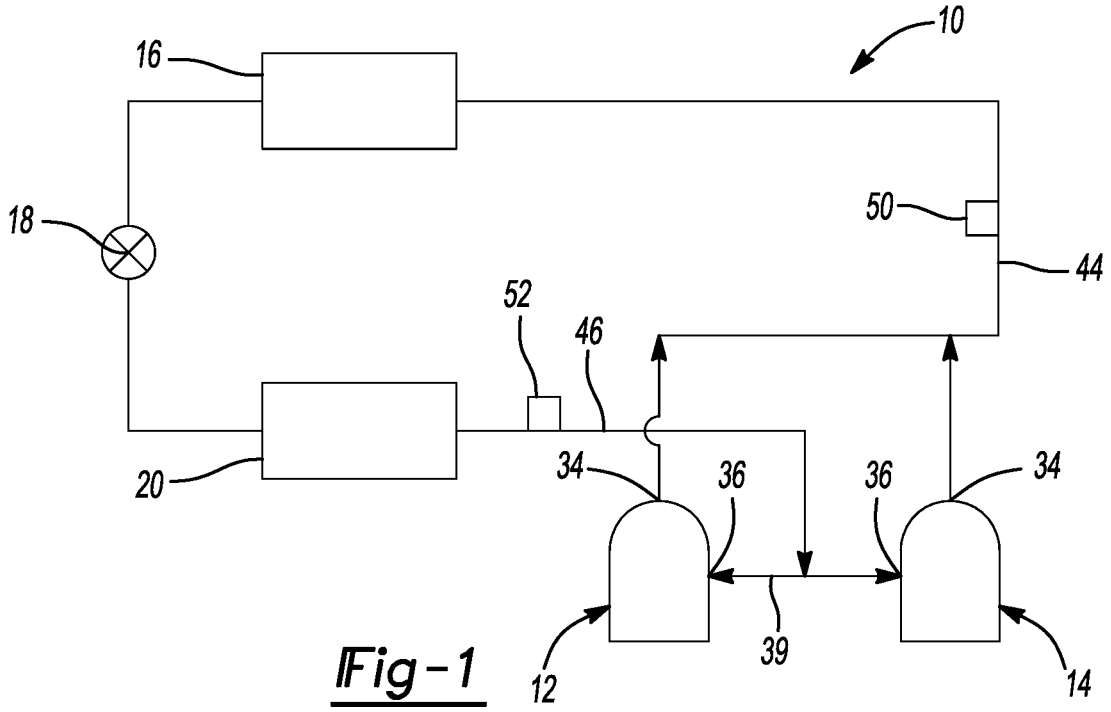
FIG. 1 is a schematic representation of a climate-control system according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected, or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer, or section. Terms such as "first," "second," and other numerical terms when used herein do not imply a sequence or order unless clearly indicated by the context. Thus, a first element, component, region, layer, or section discussed below could be termed a second element, component, region, layer, or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a climate-control system 10 is provided that may include a first compressor 12, a second compressor 14, a first heat exchanger (e.g., a condenser or gas cooler) 16, an expansion device (e.g., an expansion valve or capillary tube) 18, and a second heat exchanger (e.g., an evaporator) 20. The climate-control system 10 may be a refrigeration system, an air-conditioning system, a heat-pump system, etc. While the climate-control system 10 shown in FIG. 1 includes two compressors, in some configurations, the climate-control system 10 may include more than two compressors.

Figure 2:
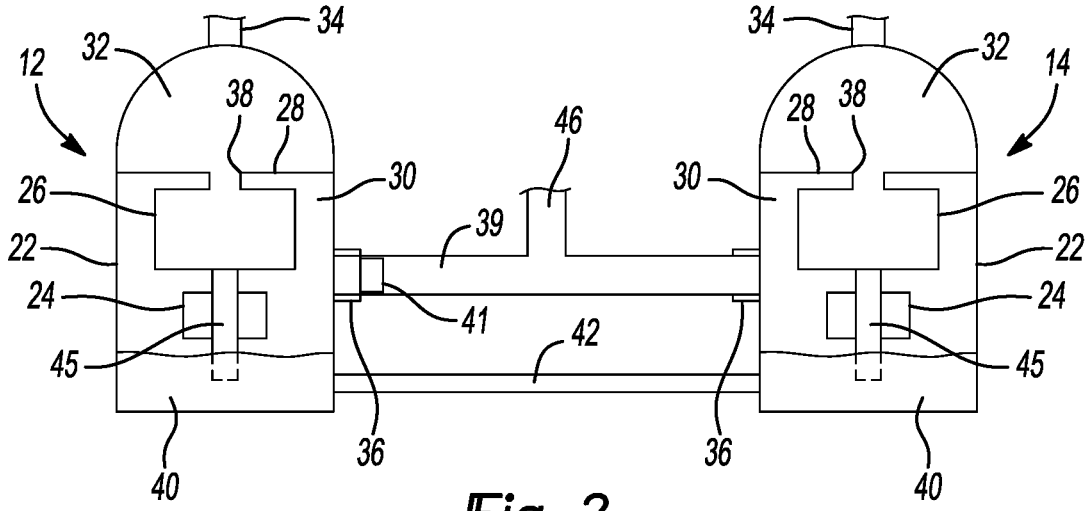
FIG. 2 is a schematic representation of first and second compressors of the climate-control system.
Figure 3:
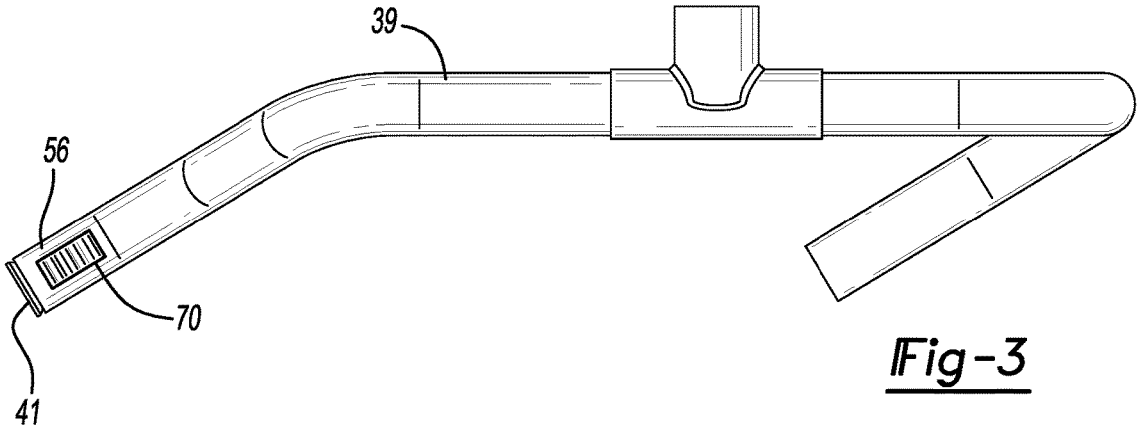
FIG. 3 is a perspective view of a suction manifold and flow restrictor of the climate-control system.
Figure 4:
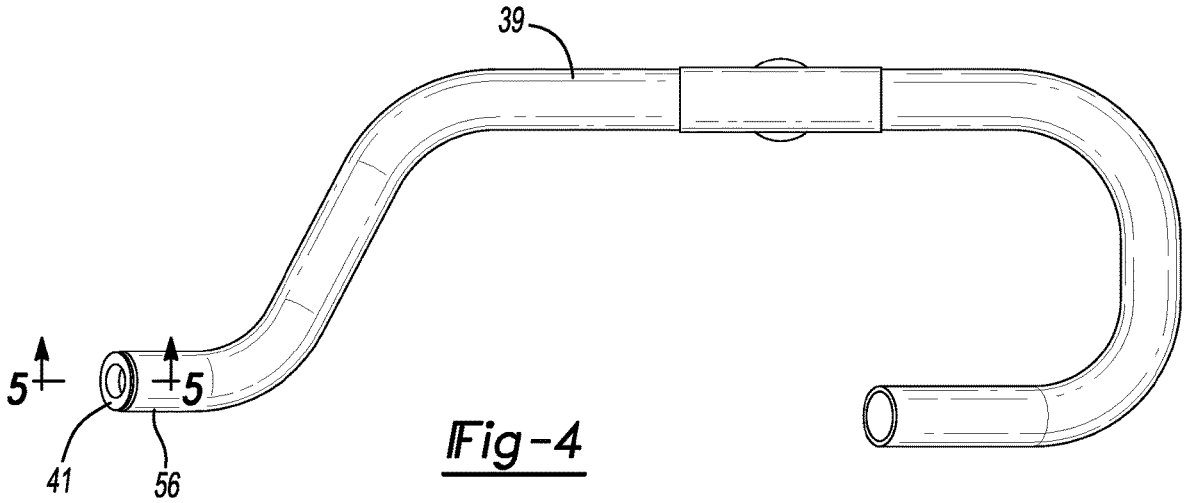
FIG. 4 is another perspective view of a suction manifold and flow restrictor of the climate-control system.

Referring now to FIG. 2, each of the first and second compressors 12, 14 may include a shell 22, a motor 24, and a compression mechanism 26. The shell 22 defines a compressor housing in which the motor 24 and compression mechanism 26 are disposed. The shell 22 may include a partition 28 that separates a suction chamber 30 from a discharge chamber 32. A discharge outlet 34 may be attached to the shell 22 and may receive compressed working fluid from the discharge chamber 32. The partition 28 may include a discharge passage 38 therethrough providing communication between the compression mechanism 26 and the discharge chamber 32. A suction inlet fitting 36 may be attached to the shell 22 and may provide suction-pressure working fluid to the suction chamber 30.

A suction manifold 39 may be fluidly coupled to the suction inlet fittings 36 of both of the compressors 12, 14. A flow restrictor 41 may be at least partially disposed in the suction manifold 39 proximate to the suction inlet fitting 36 of the first compressor 12 and may restrict the flow of working fluid from the suction manifold 39 to the suction chamber 30 of the first compressor 12. In some configurations of the system 10, a second flow restrictor (not shown) may be at least partially disposed in the suction manifold 39 proximate to the suction inlet fitting 36 of the second compressor 14 to restrict the flow of working fluid from the suction manifold 39 to the suction chamber 30 of the second compressor 14. In some configurations of the system 10, there is only a flow restrictor at the first compressor 12 and there is no flow restrictor disposed at or near the second compressor 14.

A lower end of the shell 22 may define a lubricant sump 40 containing a volume of liquid lubricant (e.g., oil). A lubricant equalization conduit 42 may extend between the first and second compressor 12, 14 and may be fluidly coupled with oil fittings attached to the shells 22 such that the lubricant equalization conduit 42 is in fluid communication with the lubricant sumps 40 of both of the compressors 12, 14.

The motor 24 may include a stator and a rotor. The stator may be press fit into the shell 22. The rotor may be fixed to a driveshaft 45, and the driveshaft 45 may drive the compression mechanism 26. The compression mechanism 26 may be a scroll compression mechanism including an orbiting scroll and a non-orbiting scroll that include spiral wraps that cooperate to define compression pockets therebetween. It will be appreciated that the compression mechanism 26 could be any other type of compression mechanism, such as a rotary compression mechanism (e.g., with an eccentric rotor rotating within a cylinder, and with a reciprocating vane extending into the cylinder) or a reciprocating compression mechanism (e.g., with a piston reciprocating within a cylinder), for example.

One or both of the compressors 12, 14 may be variable-capacity compressors. That is, one or both of the compressors 12, 14 could be or include one or more of: a multi-stage compression mechanism, a multi-speed or variable-speed motor, a vapor-injection system (e.g., an economizer circuit), a pulse-width-modulated scroll compressor configured for scroll separation (e.g., a digital scroll compressor), and a compressor having capacity-modulation valves configured to leak intermediate-pressure working fluid. It will be appreciated that one or both of the compressors 12, 14 could include any other additional or alternative structure for varying its capacity and/or the operating capacity of the system 10. Example variable-capacity compressors are disclosed in Assignee's commonly owned U.S. Pat. Nos. 8,616,014, 6,679,072, 8,585,382, 6,213,731, 8,485,789, and 8,459,053, the disclosures of which are hereby incorporated by reference. A control module (or controller) may control operation of the compressors 12, 14, including starting up the compressors 12, 14, shutting down the compressors 12, 14, and adjusting or modulating the capacities of the compressors 12, 14.

Referring now to FIGS. 1 and 2, during operation of the climate-control system 10, the compression mechanism 26 of one or both of the compressors 12, 14 may draw suction-pressure working fluid (e.g., refrigerant, carbon dioxide, etc.) from their respective suction chambers 30, may compress the working fluid to a higher pressure, and may discharge the compressed working fluid into their respective discharge chambers 32. The compressed working fluid in the discharge chambers 32 of the compressors 12, 14 may flow through the discharge outlets 34 and into a discharge conduit 44.

Working fluid in the discharge conduit 44 may flow through the first heat exchanger 16 where heat is absorbed from the working fluid. From the first heat exchanger 16, the working fluid may flow through the expansion device 18. The pressure and temperature of the working fluid drop as the working fluid flows through the expansion device 18. From the expansion device 18, the working fluid may flow through the second heat exchanger 20, where the working fluid absorbs heat from a space to be cooled. From the second heat exchanger 20, the working fluid flows to the suction manifold 39 via a suction conduit 46. From the suction manifold 39, working fluid may flow into one or both of the compressors 12, 14 through the suction inlet fittings 36.

The flow restrictor 41 at or near the suction inlet fitting 36 of the first compressor 12 changes the effective inner diameter of the working fluid flow path into the first compressor 12 and changes the suction inlet pressure of the first compressor 12. This pressure drop balances or equalizes (or reduces differences between) the pressures of working fluid within the suction chambers 30 of the first and second compressors 12, 14. Equalizing or balancing the pressures of working fluid within the suction chambers 30 of the first and second compressors 12, 14 maintains a balance of lubricant (i.e., equalizes lubricant levels) in the sumps 40 of the first and second compressors 12, 14. In other words, balancing or equalizing the working fluid pressures in the suction chambers 30 of the first and second compressors 12, 14 causes lubricant to flow through the lubricant equalization conduit 42 to balance or equalize lubricant levels in the sumps 40 of the first and second compressors 12, 14. This prevents the lubricant level within either of the compressors 12, 14 from getting too low so that both compressors 12, 14 remain adequately lubricated. The flow restrictor 41 allows compressors with different internal components, different capacities, and/or different modulation steps to be used together in the system 10.

Referring now to FIGS. 3-7, the flow restrictor 41 may include a body 50 and a flange 52. An aperture 54 may extend axially through the body 50 and the flange 52. The flange 52 is disposed at an axial end of the body 50 and extends radially outward from the body 50 such that the body 50 has a first outer diameter and the flange 52 includes a second outer diameter that is greater than the first outer diameter. The body 50 is received in an end 56 of the suction manifold 39 (e.g., the end 56 of the suction manifold 39 that is adjacent to the suction inlet fitting 36 of the first compressor 12). The flange 52 may abut an axial end surface 58 of the suction manifold 39. The flange 52 may include an angled or chamfered surface 60 that contacts the axial end surface 58. The body 50, flange 52, and aperture 54 may be fixed in size, shape, and position to provide a fixed fluid-flow restriction in the suction manifold (unlike a valve that is adjustable in size, shape and/or position).

Figure 5:
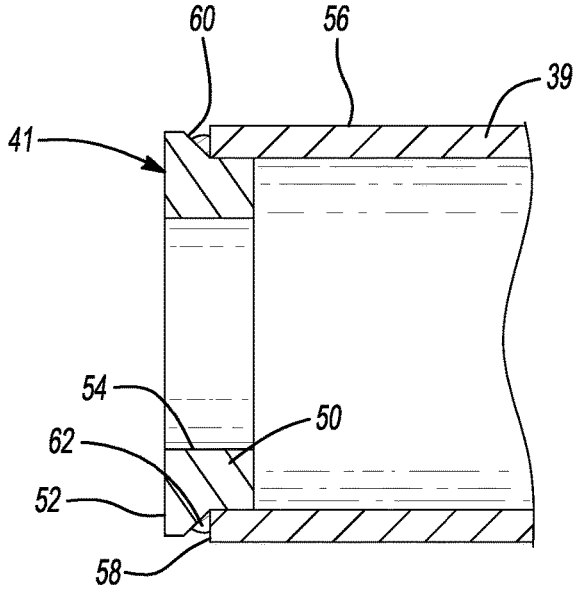
FIG. 5 is a cross-sectional view of the suction manifold and flow restrictor.
Figure 6:
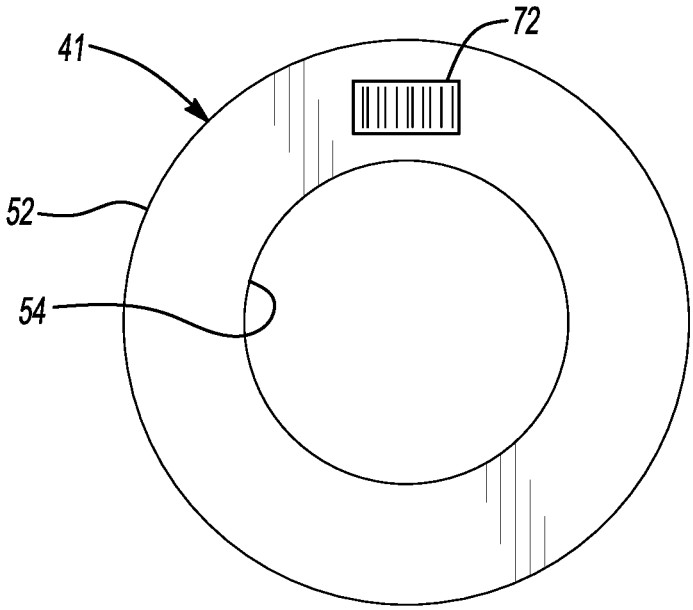
FIG. 6 is a plan view of the flow restrictor.
Figure 7:
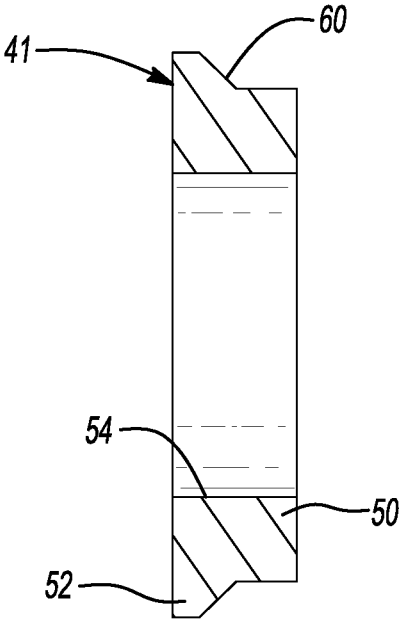
FIG. 7 is a cross-sectional view of the flow restrictor.

The flow restrictor 41 may be brazed (e.g., tack brazed) to the suction manifold 39. As shown in FIG. 5, braze material (or filler material) 62 may contact the flange 52 (e.g., the chamfered surface 60) and the axial end surface 58 of the suction manifold 39. The flange 52 allows the flow restrictor 41 to be physically installed into the suction manifold 39 while allowing an opening for the braze material to enter the joint (between the flange 52 and the suction manifold 39) and not interfere with the next level installation (e.g., connection of the suction manifold 39 to the suction inlet fitting 36 of the compressor 12. The flow restrictor 41 may be formed from brass or another suitable material. In some configurations, the braze material may be 56% (or more) silver. Other suitable braze materials may be used.

The structure of the flange 52 allows the flow restrictor 41 to be pre-installed into the suction manifold 39 and the assembly process of relabeling and visual identification verifies the proper part is used. The structure of the flow restrictor 41 allows traceability to the customer and plant of proper restrictor installation. The flow restrictor 41 is concentric to the end 56 of the suction manifold 39 and suction inlet fitting 36 of the compressor 12 to improve analytical evaluations. This will result in better warranty and reliability in returns and confidence with the customer. It will also improve the service side of multiple-compressor systems as the flow restrictor 41 will be installed and does not need to be verify during compressor changes in the field. This will also allow a standard manufacturing process and create opportunities for more compressor combinations (e.g., compressors of different capacities and/or modulation steps) to be used in a given system.

While the climate-control system 10 is described above as having two compressors 12, 14 and one flow restrictor 41, in some configurations, the climate-control system 10 could have three or more compressors and/or one or more flow restrictors. While the system 10 shown in the figures includes the flow restrictor 41 received in the end 56 of the suction manifold 39 adjacent the first compressor 12, in some configurations, a flow restrictor could be received in the end of the suction manifold 39 adjacent the second compressor 12 instead of or in addition to the flow restrictor 41 received in the end 56 of the suction manifold 39 adjacent the first compressor 12.

A manufacturer, installer, or service technician of climate-control systems or components may keep a plurality of the flow restrictors 41 described above in various sizes to accommodate various systems of various types, capacities, etc. For example, the manufacturer, installer, or service technician may keep an inventory of flow restrictors 41 having a variety of inner diameters (i.e., diameters of apertures 54). In this manner, the manufacturer, installer, or service technician may select and install a particular one of the inventory of flow restrictors 41 according to the performance parameters of a specific climate-control system.

In some configurations, all of the flow restrictors 41 in the inventory of flow restrictors may have a commonly sized outer diameter of the body 50 and a commonly sized outer diameter of the flange 52. In some configurations, the flow restrictors 41 in the inventory of flow restrictors may have markings 72 (see FIG. 6) to indicate a size of the inner diameter of the aperture 54. In some configurations, markings 70 (FIG. 3) may be applied to the suction manifold 39 to indicate the size of the inner diameter of the aperture 54 of the flow restrictor 41 that has been installed into the suction manifold 39. The markings 70, 72 can include any one or more of: a label (e.g., a sticker or tag) including a barcode and/or alpha-numeric characters that indicate the inner diameter size, engraved or stamped alpha-numeric characters, and/or any other identifying markings or indicia.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A climate-control system comprising:

a first compressor including a first shell and a first compression mechanism, the first shell defining a first suction chamber from which the first compression mechanism draws working fluid, the first shell including a first suction inlet fitting through which working fluid is drawn into the first suction chamber;

a second compressor including a second shell and a second compression mechanism, the second shell defining a second suction chamber from which the second compression mechanism draws working fluid, the second shell including a second suction inlet fitting through which working fluid is drawn into the second suction chamber;

a suction manifold fluidly connected to the first and second suction inlet fittings; and a flow restrictor disposed at least partially within the suction manifold, wherein the flow restrictor includes a body, a flange, and an aperture extending through the body and the flange, and wherein the flange extends radially outward from the body.

2. The climate-control system of claim 1, wherein the flow restrictor is brazed to the suction manifold.

3. The climate-control system of claim 1, wherein an outer diameter of the flange is larger than an inner diameter of the suction manifold.

4. The climate-control system of claim 3, wherein a braze material fixedly attaches the flow restrictor to the suction manifold.

5. The climate-control system of claim 4, wherein the braze material contacts the flange and an axial end surface of the suction manifold.

6. The climate-control system of claim 5, wherein the braze material contacts a chamfered surface of the flange.

7. The climate-control system of claim 5, wherein the flow restrictor is partially received in an end of the suction manifold and engages the first suction inlet fitting of the first compressor.

8. The climate-control system of claim 7, wherein the flow restrictor extends out of the end of the suction manifold and is concentric with the end of the suction manifold and the first suction inlet fitting.

9. The climate-control system of claim 1, wherein the first shell defines a first lubricant sump disposed within the first suction chamber, wherein the second shell defines a second lubricant sump disposed within the second suction chamber, and wherein the climate-control system further comprises a lubricant equalization conduit engaging the first and second shells and fluidly connecting the first lubricant sump with the second lubricant sump.

10. The climate-control system of claim 1, wherein the flow restrictor is partially received in a first end of the suction manifold and engages the first suction inlet fitting of the first compressor, wherein a second end of the suction manifold that engages the second suction inlet fitting, and wherein the second end of the suction manifold does not include a flow restrictor.

11. A climate-control system comprising:

a first compressor including a first shell and a first compression mechanism, the first shell including a first suction inlet fitting through which working fluid is drawn into the first compressor for compression in the first compression mechanism;

a second compressor including a second shell and a second compression mechanism, the second shell including a second suction inlet fitting through which working fluid is drawn into the second compressor for compression in the second compression mechanism;

a suction manifold fluidly connected to the first and second suction inlet fittings; and a flow restrictor disposed at least partially within the suction manifold, wherein the flow restrictor includes a body, a flange, and an aperture extending through the body and the flange, and wherein the flange extends radially outward from the body.

12. The climate-control system of claim 11, wherein the flow restrictor is brazed to the suction manifold.

13. The climate-control system of claim 11, wherein an outer diameter of the flange is larger than an inner diameter of the suction manifold.

14. The climate-control system of claim 13, wherein a braze material fixedly attaches the flow restrictor to the suction manifold.

15. The climate-control system of claim 14, wherein the braze material contacts the flange and an axial end surface of the suction manifold.

16. The climate-control system of claim 15, wherein the braze material contacts a chamfered surface of the flange.

17. The climate-control system of claim 15, wherein the flow restrictor is partially received in an end of the suction manifold and engages the first suction inlet fitting of the first compressor.

18. The climate-control system of claim 17, wherein the flow restrictor extends out of the end of the suction manifold and is concentric with the end of the suction manifold and the first suction inlet fitting.

19. The climate-control system of claim 11, wherein the first shell defines a first suction chamber and a first lubricant sump disposed within the first suction chamber, wherein the second shell defines a second suction chamber and a second lubricant sump disposed within the second suction chamber, and wherein the climate-control system further comprises a lubricant equalization conduit engaging the first and second shells and fluidly connecting the first lubricant sump with the second lubricant sump.

20. The climate-control system of claim 19, wherein the flow restrictor is partially received in a first end of the suction manifold and engages the first suction inlet fitting of the first compressor, wherein a second end of the suction manifold that engages the second suction inlet fitting, and wherein the second end of the suction manifold does not include a flow restrictor.

21. The climate-control system of claim 11, wherein at least one of the flow restrictor and the suction manifold includes markings indicating a size of an inner diameter of the flow restrictor.

* * * * *